US008523317B2

(12) United States Patent
Bober

(10) Patent No.: US 8,523,317 B2
(45) Date of Patent: Sep. 3, 2013

(54) PNEUMATIC HOLE CLEANER FOR VACUUM BELT

(75) Inventor: Henry T. Bober, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 439 days.

(21) Appl. No.: 12/431,192

(22) Filed: Apr. 28, 2009

(65) Prior Publication Data

US 2010/0271425 A1 Oct. 28, 2010

(51) Int. Cl.
*B41J 2/165* (2006.01)

(52) U.S. Cl.
USPC ..... 347/36

(58) Field of Classification Search
None
See application file for complete search history.

(56) References Cited

U.S. PATENT DOCUMENTS

| | | | | |
|---|---|---|---|---|
| 5,717,446 | A * | 2/1998 | Teumer et al. | 347/35 |
| 6,328,442 | B1 * | 12/2001 | Brinkly | 347/104 |
| 2008/0001347 | A1 * | 1/2008 | Krause et al. | 271/193 |
| 2008/0218576 | A1 | 9/2008 | Phillips et al. | |

* cited by examiner

*Primary Examiner* — Matthew Luu
*Assistant Examiner* — Alejandro Valencia
(74) *Attorney, Agent, or Firm* — Fox Rothschild LLP

(57) ABSTRACT

A print system including a vacuum blower configured to create both a vacuum pressure and exhaust, a vacuum chamber configured to distribute the vacuum pressure created by the vacuum blower, a transport belt configured to pass in close proximity to the vacuum chamber, the transport belt having a plurality of holes, and a pneumatic cleaning device configured to direct the exhaust created by the vacuum blower through one or more holes of the transport belt in close proximity to the pneumatic cleaning device. The pneumatic cleaning device includes an upper cleaning head comprising a one or more vents configured to direct air through holes in a transport belt; and a lower cleaning body. The lower cleaning body includes a muffler, a removable collection area configured to collect debris in the exhaust, and a filter configured to collect in the exhaust.

8 Claims, 4 Drawing Sheets

PNEUMATIC HOLE CLEANER FOR VACUUM BELT

BACKGROUND

The present invention relates to pneumatic cleaning systems. More specifically, the present invention relates to pneumatic belt hole cleaning systems for vacuum transport systems.

Direct-to-media printing systems typically include a printable media hold-down system. As a printable medium passes on a transport surface under a print head, the hold-down system attempts to maintain a critical print head to printable media gap as well as to prevent contact between the printable medium and the print head. Contact between printable media and the print head may result in contamination of the printable media as well as fibers from printable media becoming lodged in ink nozzles in the print head. Over time, a substantial number of fibers could become lodged in the nozzles causing the print head to clog. A clogged print head can damage printable media by printing incorrectly, waste ink, and cause significant downtime as the clogged head must be cleaned and/or replaced.

Several hold-down systems are prevalent in modern direct-to-media printing systems. One example is a vacuum/chamber transport system. In this system, a series of small holes are placed in the transport element surface, and air is sucked through the holes, away from the print head (or print head array). As the printable medium passes under the print head (or print head array), a vacuum is created under the printable medium, thereby holding the printable medium against the transport surface.

FIG. 1 illustrates an exemplary vacuum transport system 100. A printable medium 102 is transported past a print head array 104 on a transport belt 106. The transport belt 106 may be made of a highly porous material or a nonporous material with a number of holes for allowing air flow through the transport belt. These holes may be small in size (e.g., 1.0 mm in diameter) and spaced evenly apart on the transport belt 106. A vacuum blower 108 creates a vacuum pressure that is directed through a vacuum chamber 110 to the transport belt 106. The vacuum pressure pulls air through the transport belt 106 toward the vacuum blower 108 (as indicated by arrow A). The vacuum chamber 110 acts as a diffuser, spreading the vacuum pressure equally over the surface of the transport belt 106. As the printable medium 102 advances, the vacuum pressure pulls the printable medium against the transport belt 106, thereby protecting the print head array 104 from contact with the printable medium as well as providing a necessary tacking force to transport the printable medium with the transport belt through a print zone.

Vacuum hold-down systems have inherent problems, however. One problem is clogged holes in the transport belt. Fibers from the printable media, dust and debris from the ink such as stray ink drops may become lodged in the individual holes in the transport belt, thereby reducing or completely blocking the flow of air through that hole. Over time, enough holes may become clogged in the transport belt to reduce the overall vacuum pressure created by the vacuum hold-down system to a level where a printable medium may contact an individual print head (or multiple print heads in a print head array). Additionally, when a hole is clogged, dirt may be transferred to the side of the printable medium touching the vacuum belt resulting in imperfections on the printable medium.

One approach to eliminate this problem is to periodically remove the transport belt from the system in which it is installed and clean the holes in the transport belt. However, this approach results in significant downtime for the print system, as printing must be halted in order to remove the belt.

SUMMARY

Before the present methods are described, it is to be understood that this invention is not limited to the particular systems, methodologies or protocols described, as these may vary. It is also to be understood that the terminology used herein is for the purpose of describing particular embodiments only, and is not intended to limit the scope of the present disclosure which will be limited only by the appended claims.

It must be noted that as used herein and in the appended claims, the singular forms "a," "an," and "the" include plural reference unless the context clearly dictates otherwise. Thus, for example, reference to a "printable medium" is a reference to one or more printable media and equivalents thereof known to those skilled in the art, and so forth. Unless defined otherwise, all technical and scientific terms used herein have the same meanings as commonly understood by one of ordinary skill in the art. As used herein, the term "comprising" means "including, but not limited to."

In one general respect, the embodiments disclose a print system. The print system includes a vacuum blower configured to create both a vacuum pressure and exhaust, a vacuum chamber configured to distribute the vacuum pressure created by the vacuum blower, a transport belt configured to pass in close proximity to the vacuum chamber, the transport belt having a plurality of holes, and a pneumatic cleaning device configured to direct the exhaust created by the vacuum blower through one or more holes of the transport belt in close proximity to the pneumatic cleaning device.

In another general respect, the embodiments disclose a print system. The print system includes a vacuum blower configured to create both a vacuum pressure and exhaust, a vacuum chamber configured to distribute the vacuum pressure created by the vacuum blower, a transport belt configured to pass in close proximity to the vacuum chamber and configured to transport printable media past a print head array, the transport belt having a plurality of holes configured to direct the vacuum pressure created by the vacuum blower from the vacuum chamber to the printable media, and a pneumatic cleaning device configured to direct the exhaust created by the vacuum blower through one or more holes of the transport belt passing in close proximity to the pneumatic cleaning device.

In another general respect, the embodiments disclose a pneumatic cleaning device. The pneumatic cleaning device includes an upper cleaning head comprising a one or more vents configured to direct air through holes in a transport belt; and a lower cleaning body. The lower cleaning body includes a muffler, a collection area configured to collect debris in the exhaust, and a filter configured to collect debris in the exhaust.

BRIEF DESCRIPTION OF THE DRAWINGS

Aspects, features, benefits and advantages of the present invention will be apparent with regard to the following description and accompanying drawings, of which.

DETAILED DESCRIPTION

For purposes of the discussion below, a "printable medium" refers to a physical sheet of paper, corrugated board, plastic, film and/or other suitable substrate for printing images thereon.

An "exhaust duct" refers to an enclosure suitable for directing air flow between spaces in a structure or a device.

A "vacuum blower" refers to a device capable of creating one or more of a vacuum pressure and exhaust by directing air flow from one area to another.

Figure 1:
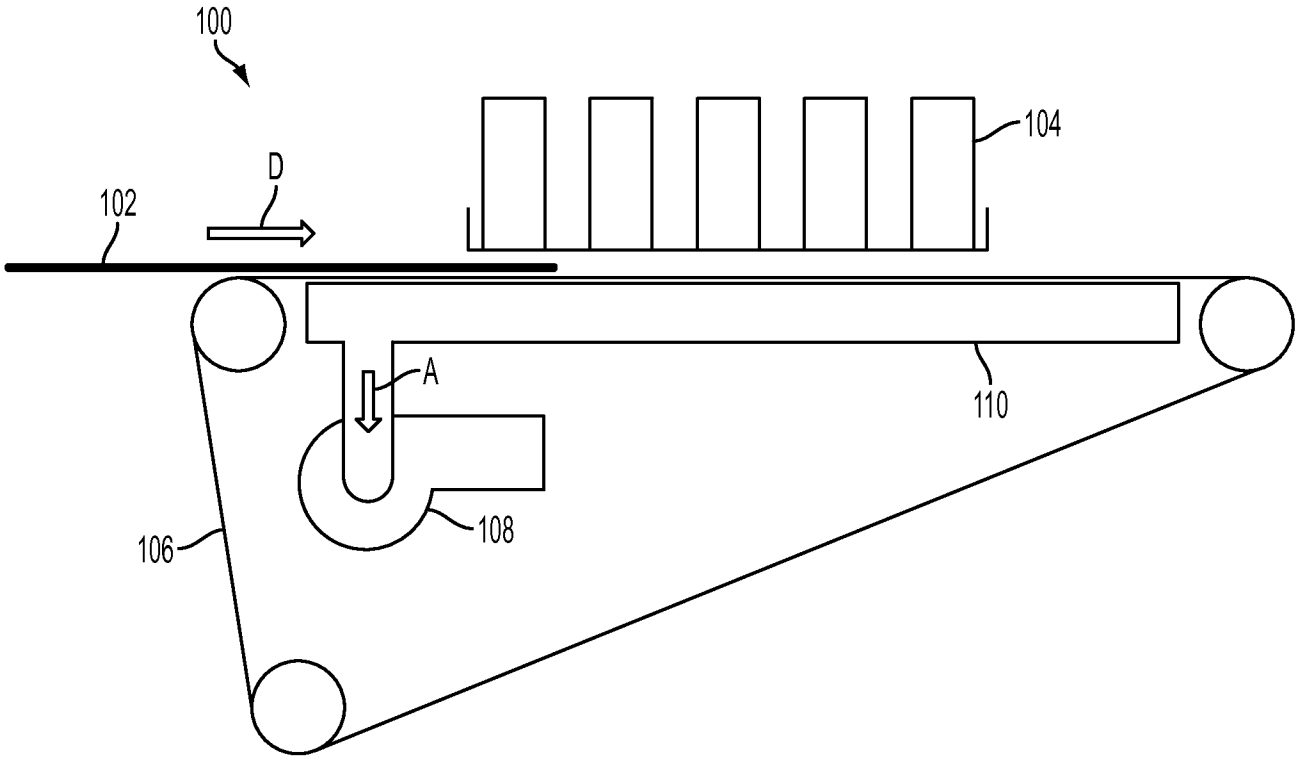
FIG. 1 illustrates an exemplary printable-media vacuum hold down system.
Figure 2A:
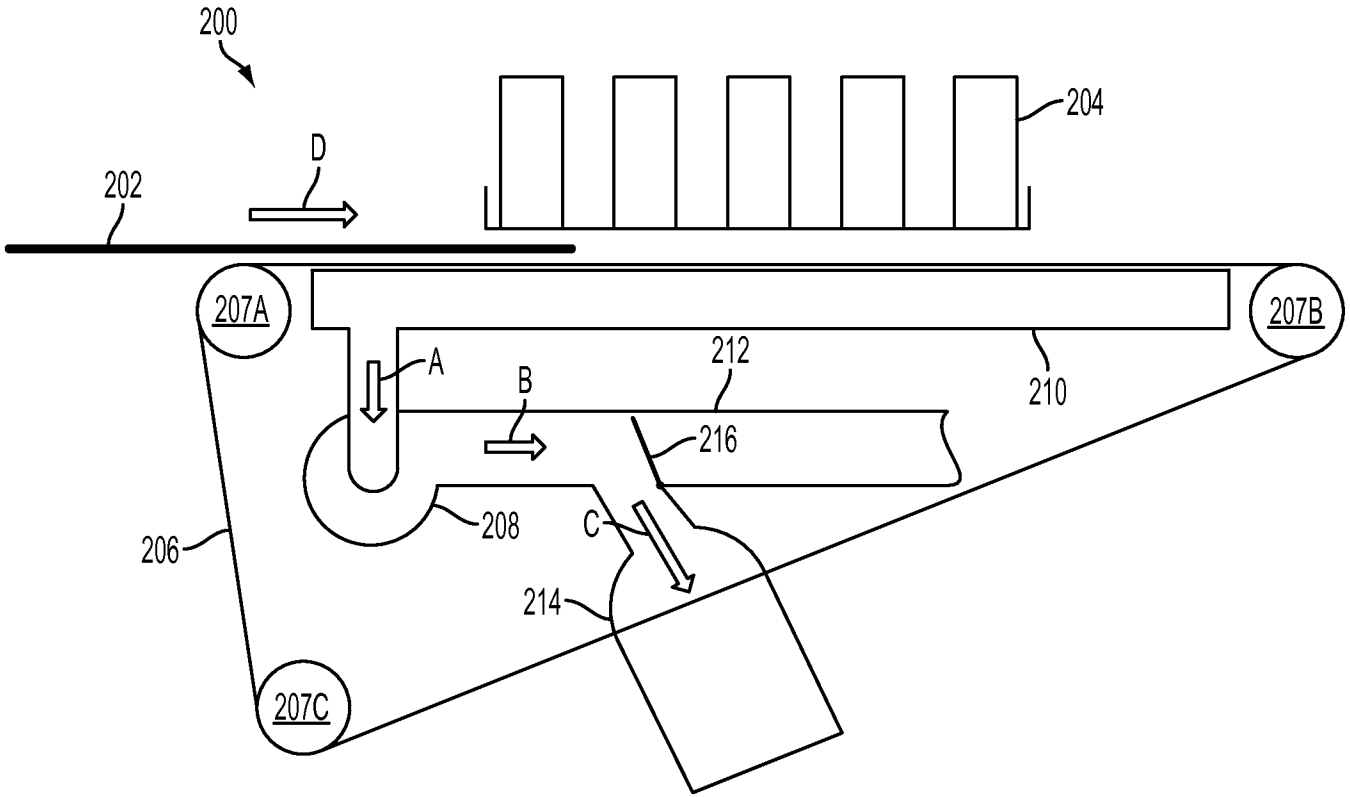
FIG. 2A illustrates a vacuum transport system having an integrated pneumatic hole cleaning device.

FIG. 2A illustrates an exemplary embodiment of a vacuum transport system 200 having a pneumatic hole cleaning device for removing debris from holes in a transport belt. Similar to the vacuum transport system 100 in FIG. 1 discussed above, the vacuum transport system 200 may be designed to transport a printable medium 202 past a print head array 204 on a transport belt 206 in a process direction shown by arrow D. The transport belt 206 may be a strip of fabric, film, elastomer or similar material that loops around, for example, three rollers, roller 207A, roller 207B and roller 207C. At least one of the rollers (e.g., the roller 207A) may be configured to rotate in a specific direction, e.g., clockwise, thereby providing a driving force that causes the transport belt 206 to move. The transport belt 206 may be made of a highly porous material or a nonporous material with a number of holes for allowing air flow through the transport belt.

Figure 2B:
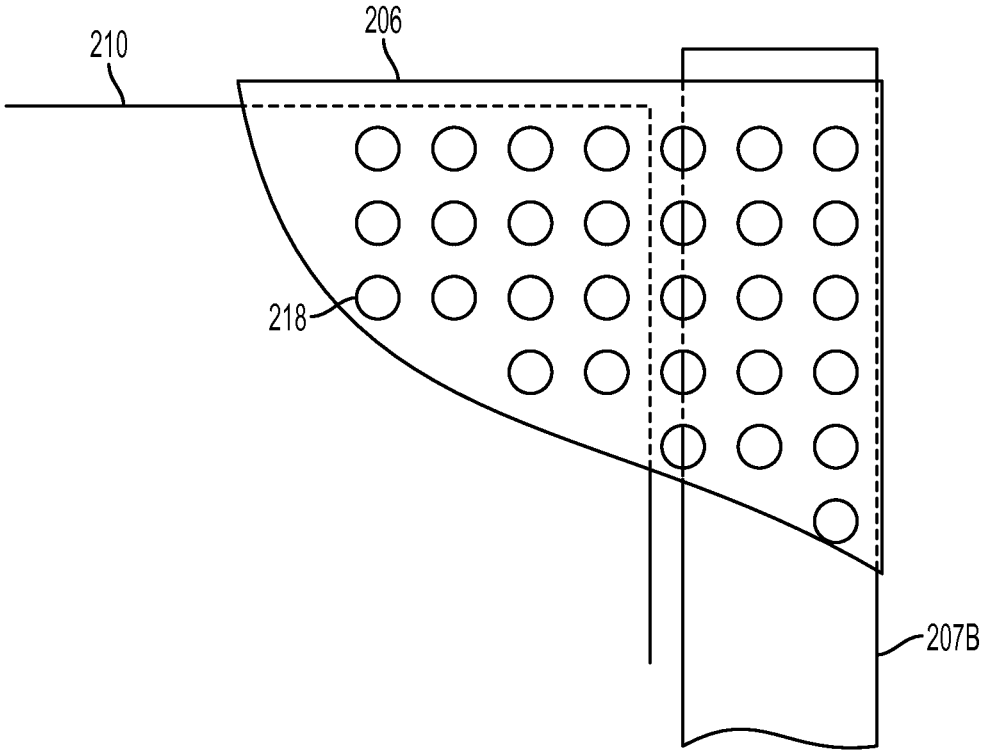
FIG. 2B illustrates a cutaway view of the transport system of FIG. 1.

FIG. 2B shows a more detailed cutaway view of vacuum transport system 200 including holes 218 of vacuum belt 206. The holes 218 may be small in size (e.g., from approximately 0.5 to approximately 2.5 mm in diameter) and spaced evenly apart on the transport belt 206 (e.g., from approximately 5 mm to approximately 15 mm apart) to enable the creation of a uniform vacuum pressure across a portion of the transport belt traveling in close proximity to a vacuum chamber 210.

Referring again to FIG. 2A, a vacuum blower 208 creates a vacuum pressure that is directed through the vacuum chamber 210 to the transport belt 206. The vacuum pressure pulls air through the transport belt 206 toward the vacuum blower 208 (as indicated by arrow A). The vacuum chamber 210 acts as a diffuser, spreading the vacuum pressure equally over the surface of the portion of the transport belt 206 in close proximity to the vacuum chamber. The vacuum chamber 210 may be positioned below the transport belt 206 between roller 207A and 207B. As the printable medium 202 advances along the transport belt 206 between roller 207A and 207B, the vacuum pressure distributed along the transport belt by the vacuum chamber 210 pulls the printable medium against the transport belt, thereby protecting the print head array 204 from contacting the printable medium.

The vacuum blower 208 may also include an exhaust duct 212 that directs air ("exhaust") away from the vacuum blower (as indicated by arrow B). The exhaust may be directed along the exhaust duct 212 toward a pneumatic cleaning device 214. The pneumatic cleaning device 214 may direct the exhaust from the vacuum blower 208 through the transport belt 206 in an opposite direction of the normal airflow through the holes (as indicated by arrow C) in order to clear debris that may be lodged in the holes of the transport belt. The pneumatic cleaning device 214 may be positioned such that a portion of the transport belt 206 remote from the print head array 204 is cleaned between roller 207B and roller 207C. The exhaust duct 212 may further include a valve 216 configured to selectively direct the exhaust towards either the pneumatic cleaning device 214 or additional exhaust ducts connected to the exhaust duct 212. Individual components of the pneumatic cleaning device 214 and additional information relating to the integration of the pneumatic cleaning device into vacuum transport system 200 is discussed in greater detail below in the discussion of FIG. 3.

Depending on the volume of air that passes through the pneumatic cleaning device 214, backpressure may be created in the vacuum blower 208, resulting in a reduced vacuum pressure exerted on the transport belt 206 by the vacuum chamber 210. Accordingly, the valve 216 may be controlled to eliminate this backpressure when a printable medium is passing over the vacuum chamber 210. For example, when the printable medium 202 is passing over the vacuum chamber 210, the valve 216 may be in a first position, closing off the pneumatic cleaning device 214, thereby directing all exhaust through the exhaust duct 212. Once the printable medium 202 is past the vacuum chamber 210, the valve 216 may be moved to a second position by any suitable electromechanical position control system, directing the exhaust through the pneumatic cleaning device 214. Depending on the distance between discrete printable media, various portions of the transport belt 206 may be cleaned.

If the printable media are positioned close together such that cleaning between individual printable media is substantially not performed, a cleaning cycle may be used during a non-printing belt maintenance cycle in which the transport belt 206 is run continuously for several complete loops of the belt, allowing for each hole in the transport belt to be cleaned a plurality of times. A belt maintenance or cleaning cycle may be run after a predetermined period of time (e.g., after 2 hours of printing time), at startup and/or at shutdown of the printing device.

Figure 3:
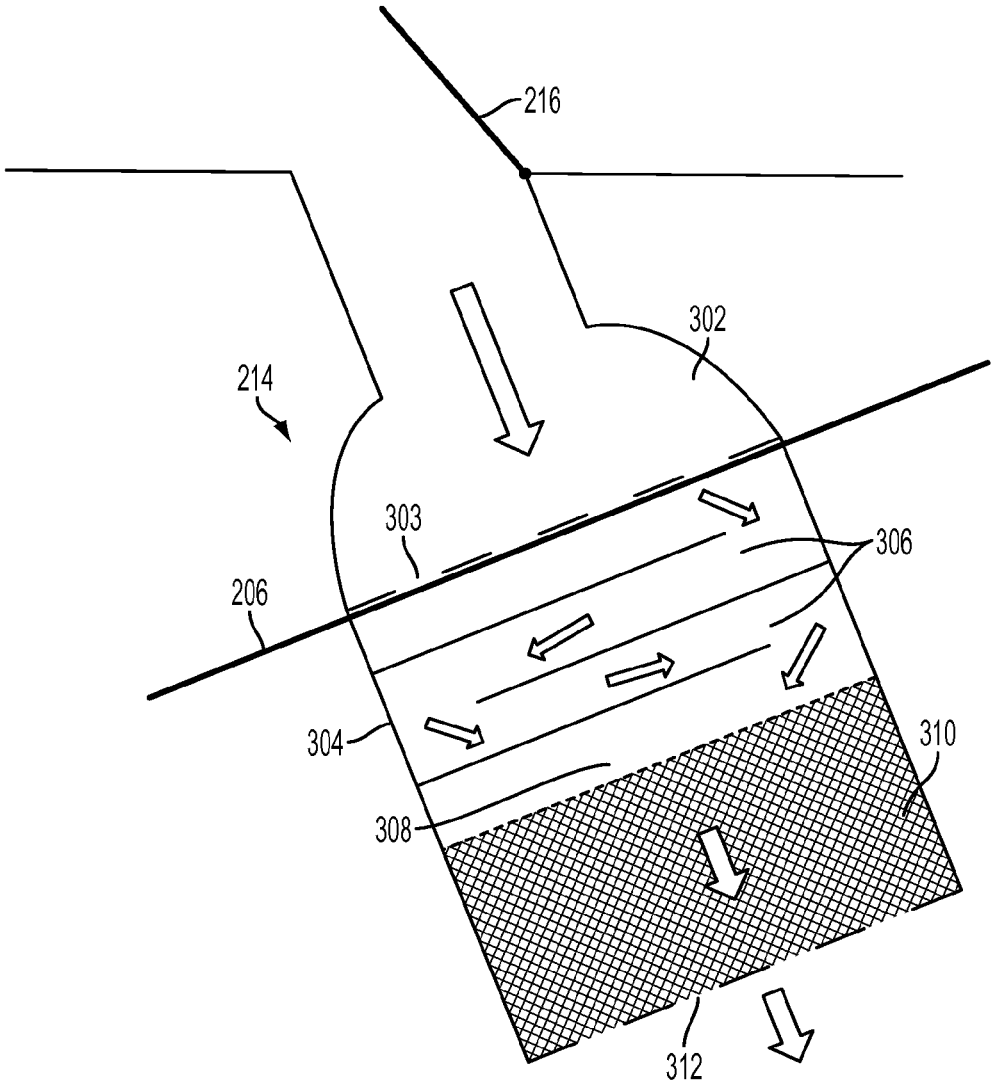
FIG. 3 illustrates a more detailed view of the collection chamber of the pneumatic hole cleaning device of FIG. 2A.

FIG. 3 illustrates a close-up view of the pneumatic cleaning device 214 and the individual components that may be included in one exemplary embodiment of the pneumatic cleaning device. The pneumatic cleaning device 214 may include two main components, an upper cleaning head 302 and a lower cleaning body 304. The transport belt 206 may pass between these two components. The upper cleaning head 302 may attach to the exhaust duct 212 near the valve 216 such that when the valve is in the second position, any exhaust passing through the exhaust duct is directed into the pneumatic cleaning device 214. The upper cleaning head 302 may be designed in various geometric shapes depending on the application or the amount of space available. For example, the upper cleaning head 302 may flare out radially from the exhaust duct 212 such that a larger surface area of the transport belt 206 passes under the upper cleaning head. The upper cleaning head 302 may be positioned in close proximity to the transport belt 206 (e.g., less than approximately 1 mm from the surface of the transport belt) and may include appropriate peripheral seals such that the amount of exhaust lost around the edges of the upper cleaning head is minimized. The upper cleaning head 302 may include one or more vents 303 for directing exhaust directly at the transport belt 206 in a direction substantially perpendicular to the surface of the transport belt. The exhaust may then pass through the individual holes of the transport belt 206, dislodging debris from the holes. The exhaust and any dislodged debris may then pass into the lower chamber 304 positioned on the exterior of the transport belt 206.

Once the exhaust passes into the lower chamber 304, the exhaust may pass through one or more mufflers 306. The one or more mufflers 306 may be designed such that they reduce or otherwise eliminate noise created by the exhaust as it passes through the pneumatic cleaning device 214 and through holes in the transport belt 206. The one or more mufflers 306 may be geometrically designed to include a resonance chamber specifically sized and positioned to produce a destructive interference. The destructive interference may be equal in frequency, but opposite in phase, to sound waves produced by the exhaust. As the exhaust passes through the resonance chamber, the sound waves created by the exhaust combine with the destructive interference to reduce or eliminate the sound of the exhaust. Similarly, the one or more mufflers 306 may include a sound dampening material such as acoustical foam. The acoustical foam may absorb sound waves produced by the exhaust to further reduce or eliminate the noise produced by the exhaust.

The exhaust and debris may pass into a collection area 308 where large pieces of debris are collected. The exhaust and smaller pieces of debris may then pass through a filter 310. Smaller pieces of debris may be collected by the filter 310, and the exhaust may exit the pneumatic cleaning device 214 through one or more exhaust vents 312.

The lower chamber 304 may be detachably mounted to a support structure such that the lower chamber may be removed and cleaned. Any debris collected in the collection area 308 may be emptied. Similarly, the filter 310 may be removed and cleaned and/or replaced.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A print system comprising:

a vacuum blower configured to create both a vacuum pressure and exhaust;

a vacuum chamber configured to distribute the vacuum pressure created by the vacuum blower;

a transport belt configured to pass in close proximity to the vacuum chamber, the transport belt having a plurality of holes; and a pneumatic cleaning device positioned such that the transport belt passes through the pneumatic cleaning device at a location where the transport belt does not carry printable media and configured to direct the exhaust created by the vacuum blower through one or more holes of the transport belt and to capture debris from the one or more holes of the transport belt as the transport belt passes through the pneumatic cleaning device, wherein at least a portion of the pneumatic cleaning device is removable such that any captured debris may be emptied from the pneumatic cleaning device.

2. The system of claim 1, further comprising an exhaust duct attached to the vacuum blower and positioned such that the exhaust is directed away from the vacuum blower.

3. The system of claim 2, further comprising a controllable valve configured to direct the exhaust through one of the exhaust duct and the pneumatic cleaning device.

4. The system of claim 1, wherein the pneumatic cleaning device comprises:

an upper cleaning head; and a lower cleaning body, wherein the transport belt passes between the upper cleaning head the lower cleaning body.

5. The system of claim 4, wherein the upper cleaning head comprises one or more vents configured to direct the exhaust through the one or more holes of the transport belt in close proximity to the pneumatic cleaning device.

6. The system of claim 4, wherein the lower cleaning body comprises:

a muffler;

a collection area configured to collect debris in the exhaust; and a filter configured to collect debris in the exhaust.

7. The system of claim 4, wherein the lower cleaning body is detachably connected to a support structure.

8. The system of claim 1, wherein the transport belt is configured to transport printable media past a print head array.

* * * * *